US008897669B2

(12) United States Patent
Matsuno

(10) Patent No.: US 8,897,669 B2
(45) Date of Patent: Nov. 25, 2014

(54) IMAGE FORMING APPARATUS

(71) Applicant: Akinori Matsuno, Osaka (JP)

(72) Inventor: Akinori Matsuno, Osaka (JP)

(73) Assignee: Kyocera Document Solutions Inc. (JP)

( * ) Notice: Subject to any disclaimer, the term of this patent is extended or adjusted under 35 U.S.C. 154(b) by 203 days.

(21) Appl. No.: 13/676,240

(22) Filed: Nov. 14, 2012

(65) Prior Publication Data

US 2013/0129380 A1 May 23, 2013

(30) Foreign Application Priority Data

Nov. 21, 2011 (JP) ..... 2011-253793

(51) Int. Cl.
*G03G 15/00* (2006.01)
*G03G 21/16* (2006.01)

(52) U.S. Cl.
CPC ..... *G03G 15/00* (2013.01); *G03G 21/1619* (2013.01)
USPC ..... 399/107

(58) Field of Classification Search
CPC ..... G03G 21/1619; G03G 2221/1678; G03G 2221/1684; G03G 21/1647; G03G 2221/1654; G03G 15/80; G03G 21/1652; G03G 2221/166
USPC ..... 399/107
See application file for complete search history.

(56) References Cited

U.S. PATENT DOCUMENTS

2006/0198657 A1 9/2006 Tsujimoto

FOREIGN PATENT DOCUMENTS

| | | |
|---|---|---|
| JP | 01-172977 | 7/1989 |
| JP | 05-3612 | 1/1993 |
| JP | 2006-208597 | 8/2006 |
| JP | 2010-200313 | 9/2010 |

*Primary Examiner* — Walter L Lindsay, Jr.
*Assistant Examiner* — Ruth Labombard
(74) *Attorney, Agent, or Firm* — Ostrolenk Faber LLP

(57) ABSTRACT

An image forming apparatus includes: a first metal side plate frame; a second metal side plate frame arranged to face the first metal side plate frame; a sheet-metal stay electrically connecting the first metal side plate frame and the second metal side plate frame; a base portion provided at the sheet-metal stay and extending horizontally; and an abutting portion rising from the base portion and abutting each of the outer surface of the first metal side plate frame and the outer surface of the second metal side plate frame, and any one of the first metal side plate frame and the second metal side plate frame is directly grounded.

7 Claims, 5 Drawing Sheets

IMAGE FORMING APPARATUS

BACKGROUND OF THE INVENTION

1. Field of the Invention

This disclosure relates to an image forming apparatus.

Priority is claimed on Japanese Patent Application No. 2011-253793 filed on Nov. 21, 2011, the contents of which are incorporated herein by reference.

2. Description of Related Art

Image forming apparatuses, such as a printer, include two side plate frames that are arranged to face each other as strength members inside a housing. Additionally, various devices (an image forming unit, a developing unit, a toner container, and the like) are arranged between these side plate frames.

In such image forming apparatuses, the side plate frame may be a grounding path. However, since the devices arranged between the side plate frames include numerous resin members (a resin case or a resin container), these devices cannot be grounding paths. For this reason, in the image forming apparatuses, overall grounding is achieved by directly grounding one side plate frame and electrically connecting the other side plate frame to a sheet-metal stay that extends horizontally at the apparatus bottom.

In addition, a flange portion is provided at the edge of the side plate frame by raising work or bending work. The above-described sheet-metal stay is fixed to the side plate frame, for example, by being fastened to this flange portion with a screw or the like.

On the other hand, the image forming apparatuses has been required to be downsized. For this reason, it is suggested that the height (the length in a direction orthogonal to the surface of the side plate frame surface) of the above flange portion is made low.

However, if the height of the flange portion becomes low, it is impossible to provide a screw hole for fastening and it is difficult to fix the sheet-metal stay and the side plate frame. For this reason, it becomes difficult to ensure the electrical connection between the sheet-metal stay and the side plate frame.

SUMMARY OF THE INVENTION

This disclosure has been embodied in view of the above-described problems, and an object thereof is to electrically connect a sheet-metal stay and a side plate frame in an image forming apparatus reliably in a case where the height of a flange portion provided at the edge of a side plate frame becomes low or even in a case where no flange portion is provided.

This disclosure adopts the following configurations as means for solving the above problems.

A first disclosure is an image forming apparatus including: a first metal side plate frame; a second metal side plate frame arranged to face the first metal side plate frame; a sheet-metal stay electrically connecting the first metal side plate frame and the second metal side plate frame; a base portion provided at the sheet-metal stay and extending horizontally; and an abutting portion rising from the base portion and abutting each of the outer surface of the first metal side plate frame and the outer surface of the second metal side plate frame, and either the first metal side plate frame or the second metal side plate frame is directly grounded.

According to this disclosure, the sheet-metal stay includes the base portion that extends horizontally and the abutting portion that rises from the base portion. Additionally, the abutting portion abuts against the outer surface of the side plate frame. For this reason, in a case where the height of the flange portion provided at the edge of the side plate frame is low, or even in a case where no flange portion is provided, it is possible to always bring the abutting portion into contact with the side plate frame.

According to this disclosure, it is possible to reliably electrically connect the sheet-metal stay and the side plate frame.

DETAILED DESCRIPTION OF THE INVENTION

One embodiment of an image forming apparatus according to this disclosure will be described below with reference to the drawings. In addition, the scales of individual members in the following drawings are appropriately changed so that each member can have a recognizable size.

Figure 1:
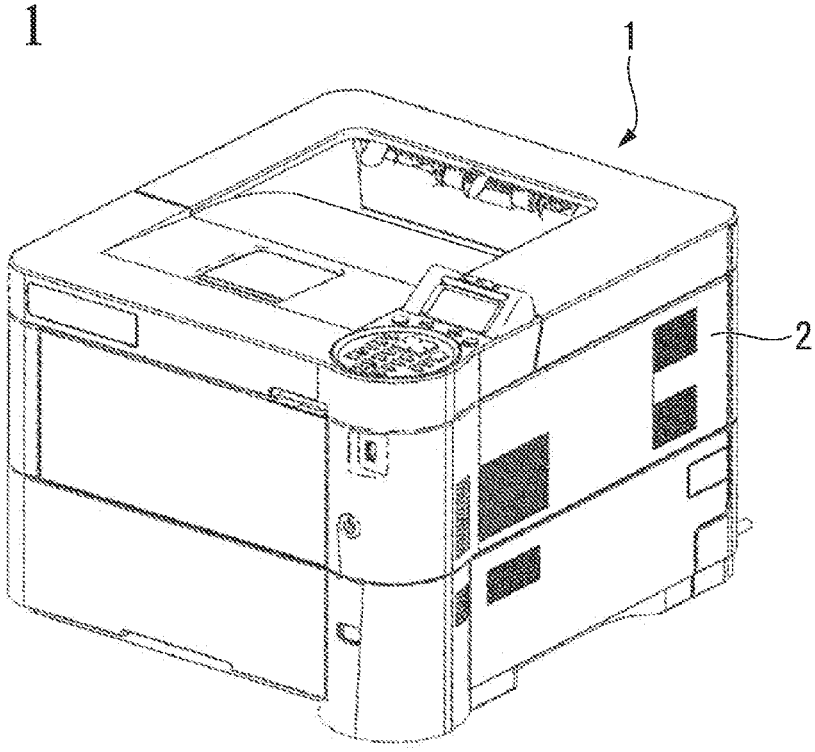
FIG. 1 is a perspective view of a printer in one embodiment of this disclosure.
Figure 2:
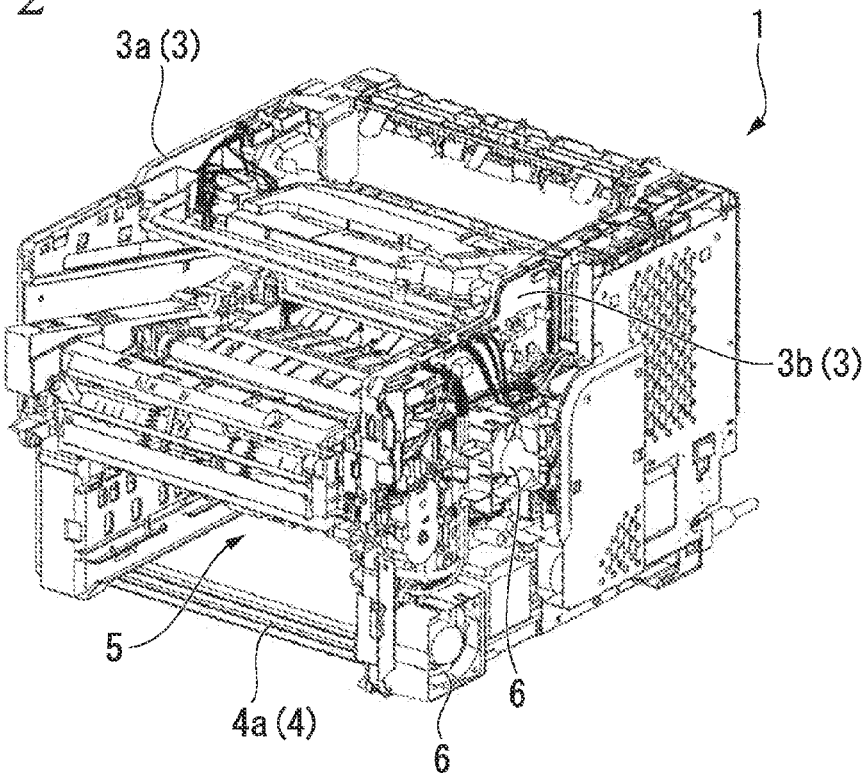
FIG. 2 is a perspective view of the printer in one embodiment of this disclosure, with a face panel being omitted.
Figure 3:
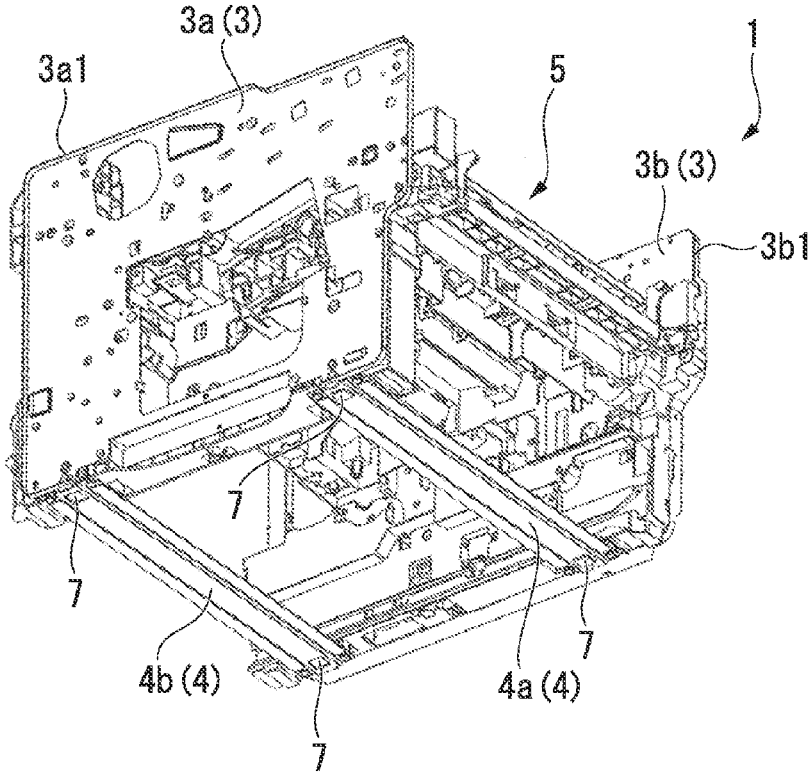
FIG. 3 is a perspective view of the printer in one embodiment of this disclosure, with devices installed at the face panel or side plate frames being omitted.

FIG. 1 is a perspective view of a printer 1 (image forming apparatus) of the present embodiment. Additionally, FIG. 2 is a perspective view of the printer 1 of the present embodiment in which a face panel is omitted. Additionally, FIG. 3 is a perspective view viewed from below, with devices installed at side plate panels being further omitted from FIG. 2. In addition, the direction in the following descriptions is a direction when the printer 1 is viewed from the front face.

As shown in FIG. 1, the printer 1 of the present embodiment is covered with a face panel 2. As shown in FIG. 2, side plate frames 3 (a left side plate frame (a first metal side plate frame) 3*a* and a right side plate frame (a second metal side plate frame) 3*b*) that are strength members, a sheet-metal stay 4 that connects the side plate frames 3, an image forming section 5 that forms an image on recording paper, other required devices (fan 6 or the like that cools the inside of the printer 1), and a rubber mount 7 are included inside the printer.

The side plate frames 3 are metallic plate-shaped strength members. As shown in FIG. 3, in the printer 1 of the present embodiment, a left side plate frame 3*a* arranged on the left side of the printer 1 and a right side plate frame 3*b* arranged on the right side are installed as the side plate frames 3. The left side plate frame 3*a* and the right side plate frame 3*b* are arranged in parallel such that their in-plane sides are made to face each other.

Figure 4:
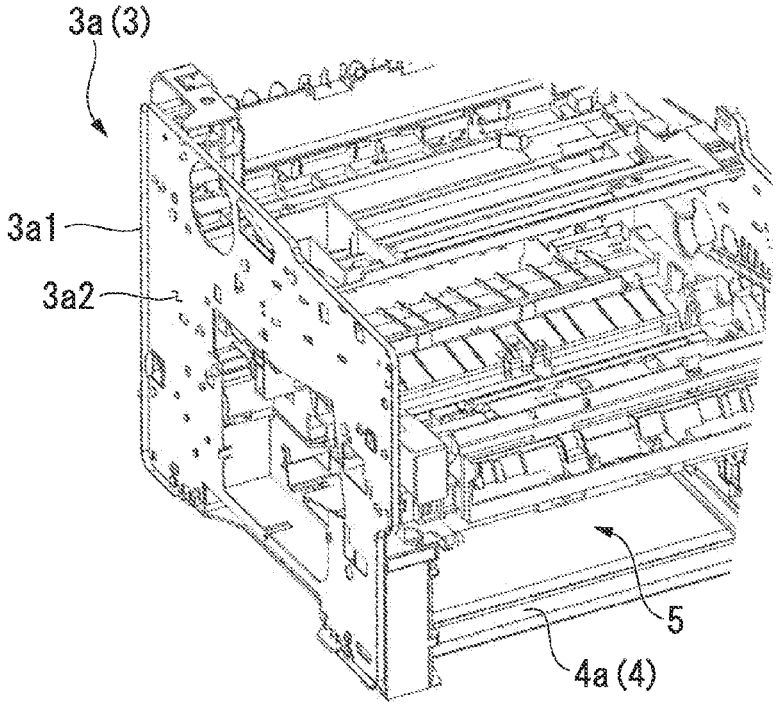
FIG. 4 is a perspective view when the left side of the printer is viewed from above in FIG. 3.

FIG. 4 is a perspective view when the left side of a printer 1 is seen from above in FIG. 3. As shown in this drawing, a flange portion 3*a*1 is provided at the edge of the left side plate frame 3*a* except for a portion on the lower side. The flange portion 3*a*1 is erected outward from an outer surface 3*a*2 of the left side plate frame 3*a*.

Figure 5:
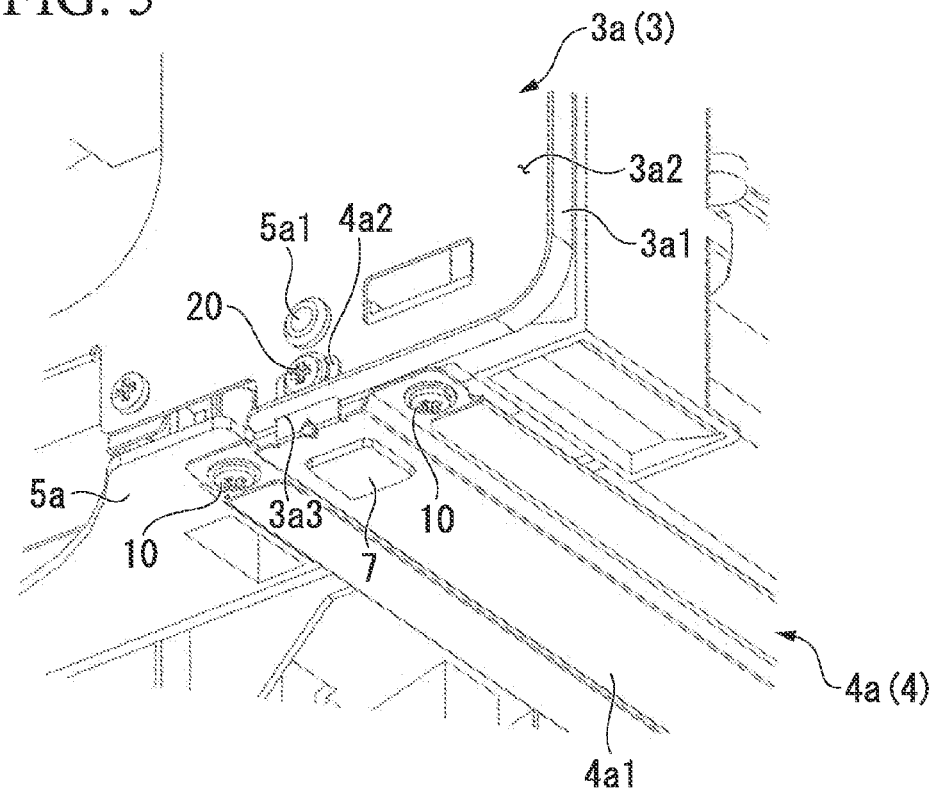
FIG. 5 is an enlarged perspective view of a connection portion between the side plate frame and a sheet-metal stay of the printer in one embodiment of this disclosure.

Additionally, FIG. 5 is an enlarged perspective view of a connection portion between the left side plate frame 3*a* and the sheet-metal stay 4.

Figure 6:
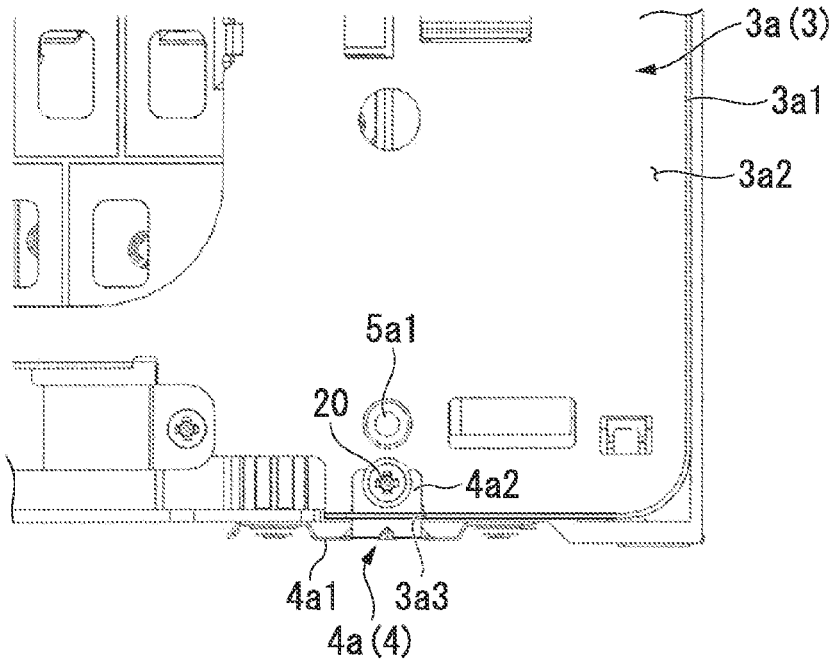
FIG. 6 is an enlarged side view of the connection portion between the side plate frame and the sheet-metal stay of the printer in one embodiment of this disclosure.

Additionally, FIG. 6 is an enlarged side view of the connection portion between the left side plate frame 3*a* and the sheet-metal stay 4. As shown in these drawings, the flange portion 3*a*1 of the left side plate frame 3*a* is provided with a through hole 3*a*3 that allows a portion of the sheet-metal stay 4 (fastening portion 4*a*2 to be described below) to pass therethrough.

In addition, although described below, two sheet-metal stays 4 are provided in the present embodiment. A connection portion between a near-side sheet-metal stay 4*a* of the two sheet-metal stays 4 arranged on the near side and the left side plate frame 3*a* is shown in an enlarged manner in FIG. 5. However, a connection portion between a back-side sheet-metal stay 4*b* arranged on the back side and the left side plate frame 3*a* is also the same as that of the structure shown in FIG. 5. Accordingly, although not shown, a through hole that allows a portion (fastening portion) of the back-side sheet-metal stay 4*b* to pass therethrough is also provided in a connection portion with the back-side sheet-metal stay 4*b*, in a flange portion 3*b*1 of the left side plate frame 3*a*.

The right side plate frame 3*b* has almost the same shape as the left side plate frame 3*a*, although the arrangement of attachment holes or the like is different due to differences in the devices to be attached. In the right side plate frame 3*b*, the flange portion 3*b*1 having a through hole through which a portion (fastening portion) of the sheet-metal stay 4 passes has a shape that is provided at the edge except for a portion on the lower side. Since the right side plate frame 3*b* has almost the same shape as the left side plate frame 3*a* in this way, the enlarged illustration is omitted.

The sheet-metal stay 4 is arranged at the bottom of the printer 1, and is a metallic long-plate-shaped member that is long in the direction separating the side plate frames 3. The sheet-metal stay 4 has a left end connected to the left side plate frame 3*a* and a right end connected to the right side plate frame 3*b*. In the printer 1 of the present embodiment, the near-side sheet-metal stay 4*a* arranged on the near side of the printer 1 and the back-side sheet-metal stay 4*b* arranged on the back side are installed as the sheet-metal stays 4.

As shown in FIG. 5, the near-side stay 4*a* includes a base portion 4*a*1 that extends horizontally and a fastening portion 4*a*2 that rises from the base portion 4*a*1. The base portion 4*a*1 extends from the left side plate frame 3*a* to the right side plate frame 3*b*, and is fastened to a resin member 5*a* provided in the image forming section 5 with screws 10. The fastening portion 4*a*2 is provided at a left end of the near-side stay 4*a*, and is set to a width capable of being inserted into the through hole 3*a*3 provided in the flange portion 3*a*1.

Figure 7:
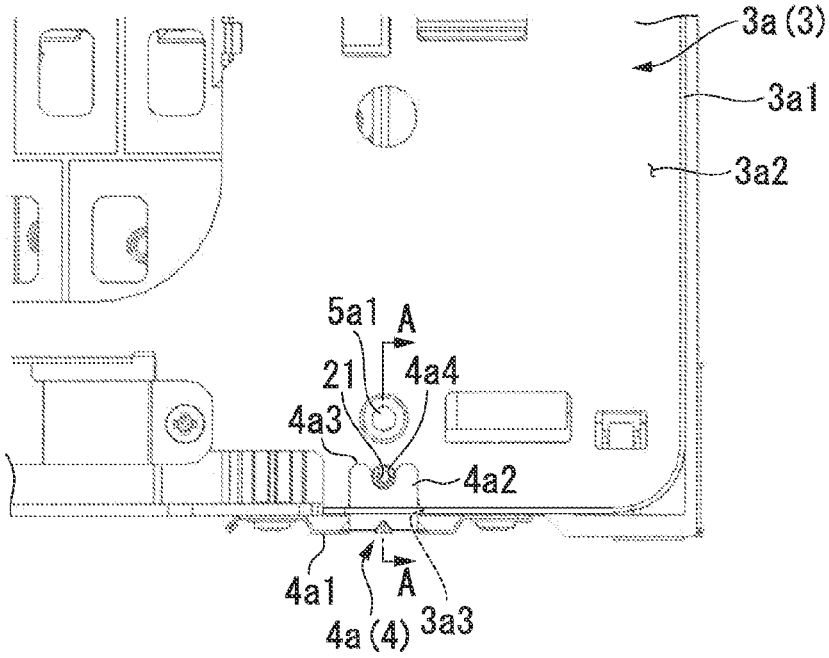
FIG. 7 is a view in which a screw that fastens a fastening portion and a left side plate frame is omitted.
Figure 8:
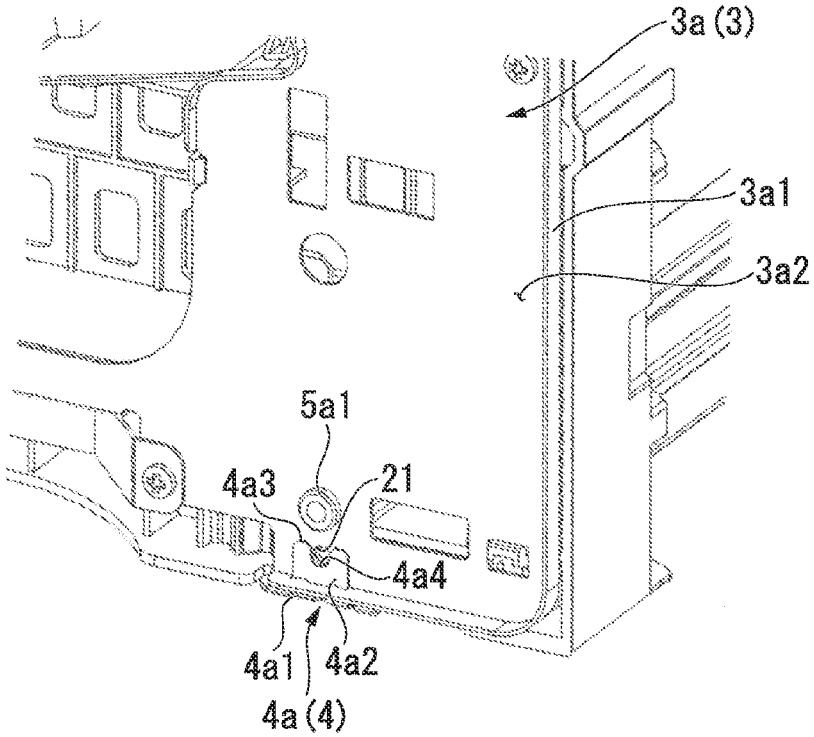
FIG. 8 is a view in which a screw that fastens the fastening portion and the left side plate frame is omitted in FIG. 5.

FIG. 7 is a side view in which a screw 20 (fastening member) that fastens the fastening portion 4*a*2 and the left side plate frame 3*a* is omitted. Additionally, FIG. 8 is a perspective view in which the screw 20 that fastens the fastening portion 4*a*2 and the left side plate frame 3*a* is omitted. As shown in these drawings, the height of the fastening portion 4*a*2 is set so that the position of an upper end 4*a*3 becomes the fastening position of the screw 20. Additionally, the fastening portion 4*a*2 has a U-shaped recess 4*a*4 that is formed by a central portion of the upper end 4*a*3 being recessed downward. The recess 4*a*4 is provided to position the shank of the screw 20, and is also used to position the near-side stay 4*a* and the left side plate frame 3*a* by being aligned with a screw hole 21 provided in the left side plate frame 3*a* during assembly.

Such a fastening portion 4*a*2, as shown in FIGS. 5 and 6, is fastened to the left side plate frame 3*a* by the screw 20 (fastening member). The fastening portion 4*a*2 abuts against the outer surface 3*a*2 of the left side plate frame 3*a*.

Additionally, fastening portions are provided also at a right end of the near-side sheet-metal stay 4*a* and at left and right ends of the back-side sheet-metal stay 4*b*. These fastening portions also have the same shape as the above fastening portion 4*a*2. Since the fastening structure between these fastening portions and the side plate frames 3 is the same as the fastening structure of the fastening portion 4*a*2 and the left side plate frame 3*a*, illustration is omitted. The fastening portion provided at the right end of the near-side stay 4*a* is fastened to the right side plate frame 3*b* by a screw (fastening member), and abuts the outer surface of the right side plate frame 3*b*. Additionally, the fastening portion provided at the left end of the back-side stay 4*b* is fastened to the left side plate frame 3*b* by a screw (fastening member), and abuts the outer surface 3*a*2 of the left side plate frame 3*a*. Additionally, the fastening portion provided at the right end of the back-side stay 4*b* is fastened to the right side plate frame 3*b* by a screw, and abuts the outer surface of the right side plate frame 3*b*.

Additionally, the left side plate frame 3*a* and the right side plate frame 3*b* are electrically connected by the near-side sheet-metal stay 4*a* and the back-side sheet-metal stay 4*b* being connected to the left side plate frame 3*a* and the right side plate frame 3*b* as described above. In the present embodiment, the side plate frames 3 are electrically connected by the sheet-metal stays 4.

Additionally, in the present embodiment, the right side plate frame 3*b* is directly grounded to an inlet that is not shown. For this reason, the left side plate frame 3*a* electrically connected to the right side plate frame 3*b* by the sheet-metal stays 4 is also indirectly grounded.

Referring back to FIG. 2, the image forming section 5, which is a principal section of the printer 1, forms an image on recording paper. The image forming section 5 includes a photoreceptor drum, a laser scanning unit, a developing unit, a toner container, a fixing device, and the like, and includes a number of resin members, such as a resin case. In addition, the resin member 5*a* shown in FIG. 5 also constitutes a portion of such an image forming section 5.

Figure 9:
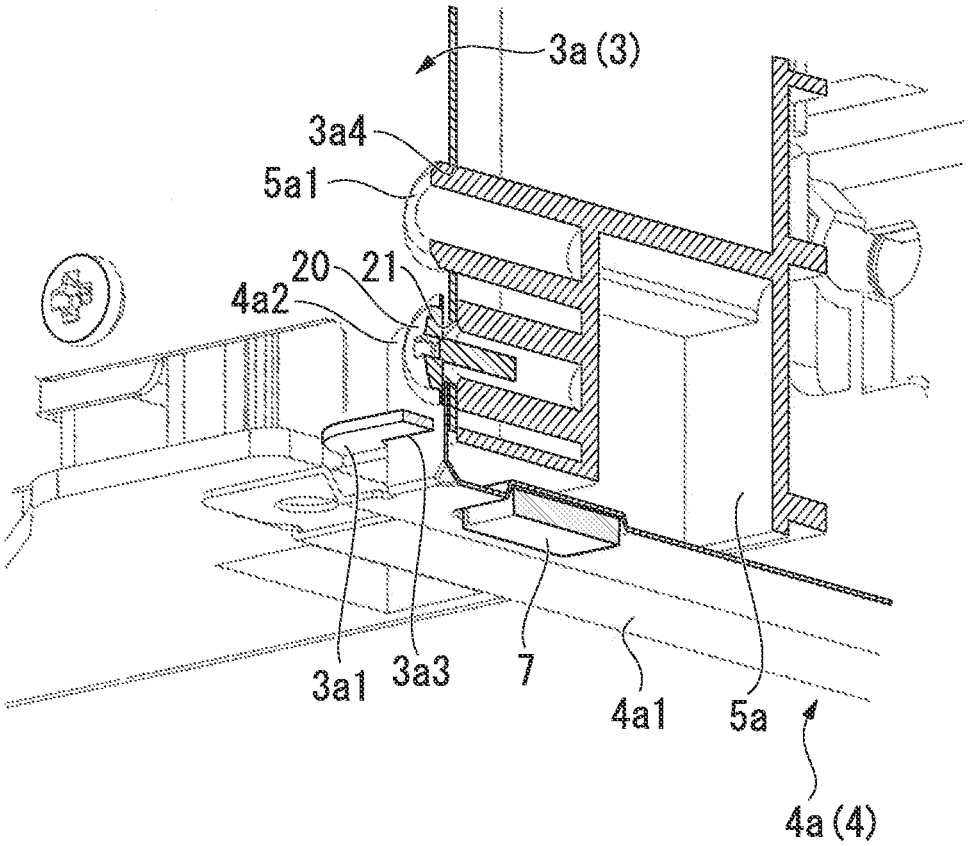
FIG. 9 is a cross-sectional perspective view taken along line A-A of FIG. 7.

FIG. 9 is a cross-sectional perspective view taken along line A-A of FIG. 7. As shown in this drawing, the resin member 5*a* includes a cylindrical projection 5*a*1 that protrudes toward the left side plate frame 3*a*. The projection 5*a*1 is inserted into a positioning hole 3*a*4 provided immediately above the fastening portion 4*a*2. The left side plate frame 3*a* and the resin member 5*a* are positioned by inserting the projection 5*a*1 of the resin member 5*a* into the positioning hole 3*a*4 of the left side plate frame 3*a* in this way. Then, the resin member 5*a* and the left side plate frame 3*a* are fastened by a screw (not shown) from the outer surface 3*a*2 side.

In this way, in the present embodiment, the positioning structure (the projection 5*a*1 and the positioning hole 3*a*4) between the resin member 5*a* (image forming section 5) and the left side plate frame 3*a* is arranged immediately above the screw 20.

In addition, positioning mechanisms that position the resin members (image forming section 5) and the side plate frames 3 are arranged immediately above some screws that fasten all the fastening portions and side plate frames 3, and are not limited to only immediately above the screw 20 that fastens the fastening portion 4*a*2 and the left side plate frame 3*a*. However, since these positioning mechanisms have the same structure as the above-described positioning mechanism including the projection 5*a*1 and positioning holes 3*a*4, illustration is omitted.

Additionally, as shown in FIG. 2, devices, such as a fan 6 for cooling the image forming section 5 and recording paper are fixed to the side plate frame 3.

In addition, for example, connectors for connecting cables, a control board that controls the printer 1, and the like are installed at the side plate frames 3.

Rubber mounts 7 (legs) are arranged at the bottom of the printer 1. The face panel 2 is not provided on the bottom face of the printer 1, and the sheet-metal stays 4 are exposed. The rubber mounts 7 are fixed to the exposed sheet-metal stays 4 via adhesive. As shown in FIG. 3, in the present embodiment, the rubber mounts 7 are installed at four corners of the bottom face of the printer 1. In a case where the printer 1 is installed on an installation surface, these rubber mounts 7 directly abut the installation surface and support the printer 1.

Additionally, at each corner of the printer 1, the rubber mount 7, the screw (screw 20), and the positioning mechanism (the projection 5*a*1 and the positioning holes 3*a*4) are arrayed linearly in the vertical direction (for example, refer to FIG. 5). In the present embodiment, the screw (screw 20, fastening member) and the positioning mechanism (the projection 5*a*1 and the positioning hole 3*a*4) are arranged immediately above the rubber mount supporting the printer 1.

According to the printer 1 of the present embodiment described above, the sheet-metal stay 4 includes the base portion 4*a*1 (the same is also true in the other base portions) that extends horizontally, and the fastening portion 4*a*2 (the same is also true hereinbelow in the other fastening portions) that rises from the base portion 4*a*1. Additionally, the fastening portion 4*a*2 abuts the outer surface 3*a*2 of the side plate frame 3. For this reason, even in a case where the height of the flange portion 3*a*1 (the same is also true in the flange portion 3*b*1) provided at the edge of the side plate frame 3 is low as in the present embodiment, it is possible to reliably bring the fastening portion 4*a*2 into contact with the side plate frame 3. According to the printer 1 of the present embodiment, it is possible to electrically connect the sheet-metal stay 4 and the side plate frame 3 reliably. In addition, even if the flange portion 3*a*1 (flange portion 3*b*1) is eliminated, it is possible to electrically connect the sheet-metal stay 4 and the side plate frame 3 reliably. According to the printer 1 of the present embodiment, the side plate frame 3 can be reliably electrically grounded as well as the size of apparatus size is reduced.

Additionally, in the printer 1 of the present embodiment, the fastening portion 4*a*2 and the side plate frame 3 are fastened by the screw 20 (the same is also true in the other screws). For this reason, the contact between the fastening portion 4*a*2 and the side plate frame 3 can be made more reliable, and the side plate frame 3 can be more reliably electrically grounded.

In addition, the fastening portion 4*a*2 abuts the outer surface of the side plate frame 3. For this reason, during assembly, screwing work can be performed from the outside of the side plate frame 3 and completion of the screwing stop work can be viewed from the outside of the side plate frame 3. Accordingly, according to the printer 1 of the present embodiment, the workability during assembly is improved.

Additionally, in the printer 1 of the present embodiment, the upper end 4*a*3 of the fastening portion 4*a*2 is set at the fastening position of the screw 20, and the recess 4*a*4 where the screw 20 is positioned is provided at the upper end of the fastening portion 4*a*2. Generally, it is considered that a screw hole is provided at a fastening portion and the screw 20 is positioned in this screw hole. However, in this case, in order to form the screw hole, it is necessary to set the upper end position of the fastening portion above the screw hole. For this reason, the height of the fastening portion becomes higher than the fastening portion 4*a*2 of the present embodiment, and the material required for forming the fastening portion increases. According to the printer 1 of the present embodiment, the fastening portion 4*a*2 with a low height is adopted, so that the sheet-metal stay 4 can be formed from little material.

Additionally, in the printer 1 of the present embodiment, the positioning structure (the projection 5*a*1 and the positioning hole 3*a*4) between the resin member 5*a* arranged between the side plate frames and the side plate frame 3, the rubber mount 7 that abuts the installation surface, and the screw 20 are arranged in the vertical direction. For this reason, a load that enters from the rubber mount 7 enters the resin member 5*a* in the vertical direction, so that deformation of the resin member 5*a* can be prevented.

Although the preferred embodiment of this disclosure has been described with reference to the accompanying drawings, this disclosure is not limited to the above embodiment. Various shapes and combinations of constituent members illustrated in the above-described embodiment are merely examples, and various changes may be made depending on design requirements or the like without departing from the disclosure.

For example, a configuration in which the fastening portion 4*a*2 is fastened to the side plate frame 3 by the screw 20 is adopted in the above embodiment.

However, this disclosure is not limited thereto. An abutting portion that reliably abuts the outer surface of the side plate frame 3 even if screwing is not performed may be used instead of the fastening portion 4*a*2. This abutting portion is also formed so as to rise from the base portion 4*a*1 of the sheet-metal stay 4, similarly to the fastening portion 4*a*2.

In a case where such an abutting portion is used, it is preferable to adopt the structure for ensuring the abutment between the abutting portion and the side plate frame 3. For example, it is considered that the structure in which the abutting portion is slightly inclined or curved to the side plate frame 3 side is adopted. In this case, by assembling the sheet-metal stay 4 and the side plate stay 4, the abutting portion is pushed outward by the side plate frame 3 and the abutting portion is brought into pressure contact with to the side plate frame 3 due to the restoring force of the abutting portion generated by this. Hence, electrical connection can be secured by causing the abutting portion and the side plate frame 3 to reliably abut each other.

Additionally, a configuration in which the recess 4*a*4 for positioning the screw 20 is U-shaped has been described in the above embodiment.

However, this disclosure is not limited thereto, and the recess may have other shapes, such as the V-shape.

Additionally, a configuration in which the rubber mount 7 is used as the leg has been described in the above embodiment.

However, this disclosure is not limited thereto, and, for example, it is also possible to provide a constricted portion at the sheet-metal stay 4 and use the constricted portion as the leg.

Additionally, a configuration in which the image forming apparatus of this disclosure is the printer 1 has been described in the above embodiment.

However, this disclosure not to be limited to this, and this disclosure may also be applied to image forming apparatuses, such as a copying machine, a facsimile, or a composite machine including a plurality of functions.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. An image forming apparatus comprising:

a first metal side plate frame;

a second metal side plate frame arranged to face the first metal side plate frame;

a sheet-metal stay electrically connecting the first metal side plate frame and the second metal side plate frame;

a base portion provided at the sheet-metal stay and extending horizontally; and an abutting portion rising from the base portion and abutting each of an outer surface of the first metal side plate frame and an outer surface of the second metal side plate frame, wherein any one of the first metal side plate frame and the second metal side plate frame is directly grounded.

2. The image forming apparatus according to claim 1, further comprising:

a flange portion formed at an edge of each of the first metal side plate frame and the second metal side plate frame and erected from each of the outer surface of the first metal side plate frame and the outer surface of the second metal side plate frame; and a through hole provided in the flange portion, wherein the abutting portion abuts each of the outer surface of the first metal side plate frame and the outer surface of the second metal side plate frame through the through hole.

3. The image forming apparatus according to claim 2, wherein the abutting portion is provided with a fastening portion that is fastened to the first metal side plate frame and the second metal side plate frame by use of a fastening member.

4. The image forming apparatus according to claim 3, wherein: the fastening member is a screw, the screw fastens the fastening portions to outsides of the outer surface of the first metal side plate frame and the second metal side plate frame by tightening the outsides thereof.

5. The image forming apparatus according to claim 3, wherein the fastening portion includes a recess, the recess is formed so as to be recessed downward at a portion of an upper end of the abutting portion, and a position of the recess is aligned by the fastening member.

6. The image forming apparatus according to claim 3, further comprising:

a resin member arranged between the first metal side plate frame and the second metal side plate frame;

a positioning structure provided at each of the first metal side plate frame and the second metal side plate frame; and a leg attached to the base portion of the sheet-metal stay, abutting an installation surface, wherein the resin member, the positioning structure, the leg, and the fastening portion are arrayed in a vertical direction.

7. The image forming apparatus according to claim 6, wherein the resin member is fastened to the first metal side plate frame and the second metal side plate frame, and the base portion of the sheet-metal stay is fastened to the resin member near the leg.

* * * * *